US006638443B2

(12) United States Patent
Iyengar et al.

(10) Patent No.: US 6,638,443 B2
(45) **Date of Patent: *Oct. 28, 2003**

(54) OPTIMIZED SYNTHETIC BASE LIQUID FOR MAGNETORHEOLOGICAL FLUID FORMULATIONS

(75) Inventors: Vardarajan R. Iyengar, Pontiac, MI (US); Robert T. Foister, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 62 days.

This patent is subject to a terminal disclaimer.

(21) Appl. No.: 09/961,217

(22) Filed: Sep. 21, 2001

(65) Prior Publication Data

US 2003/0057395 A1 Mar. 27, 2003

(51) Int. Cl.[7] ..... H01F 1/44
(52) U.S. Cl. ..... 252/62.52
(58) Field of Search ..... 252/62.52

(56) References Cited

U.S. PATENT DOCUMENTS

| | | | | |
|---|---|---|---|---|
| 4,957,644 | A | 9/1990 | Price et al. | 252/62.52 |
| 4,992,190 | A | 2/1991 | Shtarkman | 252/62.52 |
| 5,354,488 | A | 10/1994 | Shtarkman et al. | 252/62.56 |
| 5,382,373 | A | 1/1995 | Carlson et al. | 252/62.55 |
| 5,578,238 | A | 11/1996 | Weiss et al. | 252/62.52 |
| 5,599,474 | A | 2/1997 | Weiss et al. | 252/62.52 |
| 5,645,752 | A | 7/1997 | Weiss et al. | 252/62.54 |
| 5,667,715 | A | 9/1997 | Foister | 252/62.52 |
| 5,683,615 | A | 11/1997 | Munoz | 252/62.52 |
| 5,906,767 | A | 5/1999 | Karol et al. | 252/62.52 |
| 5,985,168 | A | 11/1999 | Phule | 252/62.52 |
| 5,989,447 | A | 11/1999 | Podszun et al. | 252/62.52 |
| 5,994,605 | A | 11/1999 | Bak et al. | 585/525 |
| 6,027,664 | A | 2/2000 | Weiss et al. | 252/62.52 |
| 6,132,633 | A | 10/2000 | Carlson | 252/62.52 |
| 6,149,832 | A * | 11/2000 | Foister | 252/62.52 |
| 6,180,575 | B1 | 1/2001 | Nipe | 508/227 |
| 6,203,717 | B1 | 3/2001 | Munoz et al. | 252/62.52 |
| 2001/0032961 | A1 * | 10/2001 | Iyengar | 252/62.52 |
| 2001/0045540 | A1 * | 11/2001 | Iyengar | 252/62.52 |
| 2002/0000533 | A1 * | 1/2002 | Iyengar et al. | 252/62.55 |

* cited by examiner

*Primary Examiner*—C. Melissa Koslow
(74) *Attorney, Agent, or Firm*—Scott A. McBain

(57) ABSTRACT

A magnetorheological fluid formulation in which the base liquid is optimized to exhibit an acceptable viscosity, a low volatility, improved low temperature flow properties, and an improved elastomeric compatibility. The fluid formulation includes a base liquid containing a mixture of 1-dodecene polyalphaolefin and a diester, such as dioctyl sebacate. The diester is added to the mixture in an amount effective to produce seal swelling and to lower the pour point. The viscosity of the fluid formulation is suitable for diverse vibration damping applications that require a vibration damping device to operate in the temperature range of about −40° C. to about 100° C. The low volatility and seal swelling properties of the fluid formulation reduce, inhibit or eliminate fluid loss about the seals of the vibration damping device.

20 Claims, 2 Drawing Sheets

OPTIMIZED SYNTHETIC BASE LIQUID FOR MAGNETORHEOLOGICAL FLUID FORMULATIONS

FIELD OF THE INVENTION

This invention relates to magnetorheological fluids and, in particular, to base liquids suitable for magnetorheological fluid formulations.

BACKGROUND OF THE INVENTION

Magnetorheological (MR) fluids are substances that exhibit an ability to change their flow characteristics by several orders of magnitude and in response times on the order of milliseconds under the influence of an applied magnetic field. An analogous class of fluids are electrorheological (ER) fluids which exhibit a like ability to change their flow or rheological characteristics under the influence of an applied electric field. In both instances, these induced rheological changes are completely reversible. The utility of these materials is that suitably configured electromechanical actuators which use magnetorheological or electrorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts, and in numerous electronically controlled force/torque transfer devices, such as clutches and brakes.

MR fluids are noncolloidal suspensions of finely divided (typically one to 100 microns in diameter) low coercivity, magnetizable particles of a material such as iron, nickel, cobalt, and their magnetic alloys dispersed in a base liquid or liquid vehicle such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, for example, about one Tesla. At the present state of development, MR fluids appear to offer significant advantages over ER fluids, particularly for automotive applications, because the MR fluids are less sensitive to common contaminants found in such environments, and they display greater differences in Theological properties in the presence of a modest applied field. Examples of magnetorheological fluids are illustrated, for example, in U.S. Pat. No. 4,992,190 issued Feb. 12, 1991, entitled "Fluid Responsive to a Magnetic Field"; U.S. Pat. No. 5,167,850 issued Dec. 1, 1992, entitled "Fluid Responsive to a Magnetic Field"; U.S. Pat. No. 5,354,488 issued Oct. 11, 1994, entitled "Fluid Responsive to a Magnetic Field"; U.S. Pat. No. 5,382,373 issued Jan. 17, 1995, entitled "Magnetorheological Particles Based on Alloy Particles"; and U.S. Pat. No. 5,667,715 issued Sep. 16, 1997, entitled "Magnetorheological Fluids."

As suggested in the above patents and elsewhere, the viscosity of a typical MR fluid, in the absence of a magnetic field, is a function of variables such as base liquid composition, particle composition, particle size, the particle loading, temperature, and the like. However, in the presence of an applied magnetic field, the suspended magnetizable particles agglomerate to thicken or gel the MR fluid and drastically increase its effective viscosity. In the absence of a magnetic field, the base liquid must have an acceptable viscosity over a range of continuous operating temperatures.

The viscosity of the MR fluid is acceptable if the base liquid is flowable at all temperatures within the range of continuous operating temperatures. For example, a suitable base liquid should have a viscosity in the range of about 13 centipoise (cp) to about 16 cp at a continuous operating temperature of about 20° C., and a viscosity in the range of about 90 cp to about 120 cp at a continuous operating temperature of about −20° C.

The base liquid must also exhibit compatibility with any elastomeric seals which the MR fluid wets in the MR device and which maintain the MR device liquid-tight. Furthermore, the base liquid must have a depressed volatility so that significant amounts of MR fluid are not vaporized or volatized. The elastomeric seals in MR devices are neither designed nor intended to provide a gas-tight fit. As a result, volatized base liquid can escape from the MR device by permeating between the elastomeric seals and their respective sealing surfaces. Finally, the base liquid must have a pour point that is less than the minimum continuous operating temperature. The pour point of the base liquid represents the lowest ambient temperature at which the MR device can operate.

MR devices utilized in certain automotive applications subject the MR fluid to continuous operating temperatures ranging between about −40° C. and about 100° C. Synthetic hydrocarbon base liquids currently used for such MR fluids typically contain a mixture of synthetic hydrocarbons known as polyalphaolefins or PAOs that are derived from the $C_{10}$ monomer 1-decene, $H_2C{:}CH(CH_2)_7CH_3$. Dimer 1-decene polyalphaolefin has a 20-atom carbon chain length and is oligomerized from the monomer. Dimer 1-decene polyalphaolefin has an acceptable viscosity over the operating temperature range of such MR device applications. However, dimer 1-decene polyalphaolefin has an unacceptably high volatility if heated to a temperature near the upper end of the operating temperature range of the aforementioned MR devices. Trimer 1-decene polyalphaolefin is a 30-atom carbon chain length molecule formed by a oligomerization reaction from the monomer. Trimer 1-decene polyalphaolefin has a negligible volatility when heated to a temperature near the upper end of the operating temperature range but has an unacceptably high viscosity over the operating temperature range of such MR devices. To provide a base liquid with an acceptable volatility and viscosity and a volatility considered suitable for use in fluid formulations used in such MR devices, trimer 1-decene polyalphaolefin and dimer 1-decene polyalphaolefin are blended.

The viscosity and the volatility of these mixtures of dimer 1-decene polyalphaolefin and trimer 1-decene polyalphaolefin, such as a typical 50:50 blend of a mixture by volume, are superior in these MR device applications to a base liquid comprising either one of the 1-decene polyalphaolefins alone. The addition of dimer 1-decene polyalphaolefin to the blend lowers the effective viscosity of the mixture to an acceptable value. However, the significant volatility of the dimer 1-decene polyalphaolefin at temperatures less than about 100° C. contributes to an increasingly significant loss of the base liquid of the MR fluid. Thus, an MR device containing an MR fluid formulated with a base liquid consisting of a 50:50 mixture of dimer 1-decene polyalphaolefin and trimer 1-decene polyalphaolefin would exhibit a significant loss of base liquid about its elastomeric seals when the MR device is operating at a continuous operating temperature near 100° C.

In certain MR devices used in automotive applications for vibration damping, annular elastomeric seals are utilized to provide a dynamic seal for a piston rod attached to a piston which reciprocates in response to the applied vibrations. The inner and outer diameters of such annular elastomeric seals can be dimensioned so as to provide liquid-tight seals, respectively, with the exterior of the moving piston rod and with the gland or sealing groove in which the seal is captured. However, such sizing would result in a high friction between the piston rod and the elastomeric seal if the seal experiences a volumetric expansion when exposed to the MR fluid.

Seal swell is the swelling of elastomeric gaskets or seals as a result of exposure to petroleum, synthetic lubricants, or other hydraulic fluids. Elastomeric seal materials vary widely in their resistance to the effect of such fluids. To take advantage of the volumetric expansion due to seal swelling, the elastomeric seals in MR devices are intentionally undersized to minimize the friction between the piston rod and the seal and to provide a moderate amount of swelling which is relied upon to improve the sealing action. Specifically, these MR devices require that the elastomeric seals swell by about 2 percent to about 6 percent by volume, as quantified by a 70 hour soak in the particular MR fluid at 100° C. On the other hand, excessive swelling of elastomeric seals in excess of about 6 percent is equally undesired since the performance of the MR device will be degraded. The seal swell provides effective sealing of the reservoir or damper body holding the MR fluid and participates in minimizing fluid loss from the MR device.

Polyalphaolefins cause elastomeric seals wetted by the MR fluid in an MR device to shrink or, at best, to swell an amount insufficient to prevent loss of the base liquid of the MR fluid about the seals. Therefore, a base liquid formed from a mixture of dimer 1-decene polyalphaolefin and trimer 1-decene polyalphaolefin cannot provide the requisite amount of seal swelling to meet MR device requirements. As a result, the loss of MR fluid about the elastomeric seals may be significant in those MR devices which utilize a mixture of dimer 1-decene polyalphaolefin and trimer 1-decene polyalphaolefin as a base liquid and may contribute to premature failure of such MR devices.

Seal swelling also provides the elastomeric seals in an MR device with the ability to repair incremental losses of the outer surface due to frictional wear as the piston rod reciprocates. As material is removed from the outer surface, swelling of the newly exposed portion of the surface can at least partially restore the local seal and prevent or reduce leakage. A base liquid, such as a mixture of dimer 1-decene polyalphaolefin and trimer 1-decene polyalphaolefin, does not exhibit this property because the amount of seal swelling of wetted elastomeric seals is insufficient. The inability to maintain a liquid-tight seal as the elastomeric seal erodes would contribute to an accelerated fluid loss from the damper reservoir.

Fluid loss occurs in virtually all MR devices utilized in automotive applications due to loss of volatized base liquid, inherent aspects of dynamic elastomeric seals and the effects of frictional wear. Ideally, the loss of base liquid should be insignificant over the lifetime of MR damper. Base liquids for MR fluid formulations that exhibit a significant volatility and/or an insufficient seal swelling ability, such as mixtures of dimer 1-decene polyalphaolefin and trimer 1-decene polyalphaolefin, can accelerate the loss of base liquid from the MR device and cause the MR device to fail before the projected lifetime.

Premature failure of an MR device due to fluid loss can arise from at least two mechanisms. In one mechanism, the loss of base liquid can cause the MR device to lose its ability to effectively absorb the vibrational energy imparted by the piston of the MR device and dampen the vibration. Second, the loss of base liquid can increase the concentration of magnetizable particles in the MR fluid. As a result, the viscosity of the MR fluid is increased and, in the presence of a magnetic field, the effective viscosity of the MR fluid is likewise increased. It follows that the vibration dampening response of the MR device will be degraded because the piston of the MR device will experience a large resistance to movement as it moves in the MR fluid thickened by fluid loss.

There is thus a need to develop a base liquid for an MR fluid formulation having an acceptable viscosity, a low pour point, a low volatility and a suitable amount of seal swelling so as to reduce, inhibit, or eliminate the loss of base liquid from an MR device while providing suitable lubrication over the range of temperatures in which the MR device is operating.

SUMMARY OF THE INVENTION

The present invention provides a magnetorheological fluid formulation for a magnetorheological device having an acceptable viscosity, a low pour point, a low volatility, and an effective elastomeric seal compatibility. The magnetorheological fluid formulation comprises a suspension of magnetizable particles dispersed in a base liquid that is a mixture of a dimer 1-dodecene polyalphaolefin and a diester. The diester is provided in an amount by volume, such as between about 10% and about 45% by volume relative to the total volume of the base liquid, which is effective to sufficiently swell the elastomeric seals of the magnetorheological device wetted by the magnetorheological fluid by a given percentage, such as between about 2 percent and about 6 percent.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
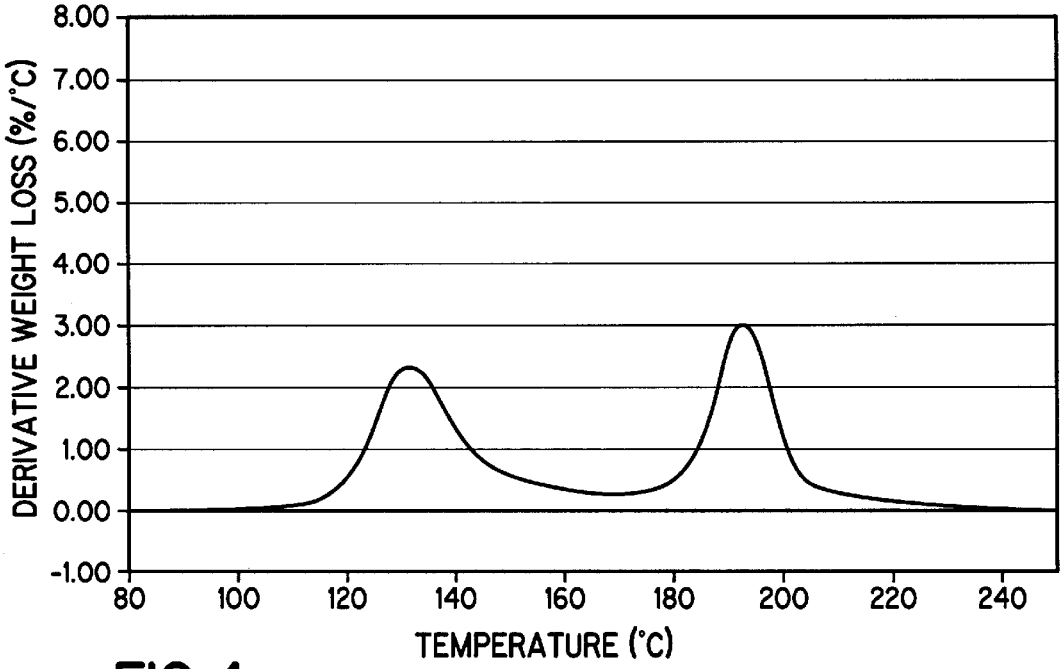
FIG. 1 PRIOR ART
FIG. 1 is a graphical representation of a thermogravimetric analysis of a base liquid for an MR fluid formulation of a 50:50 mixture by volume of a dimer 1-decene polyalphaolefin and a trimer 1-decene polyalphaolefin in accordance with the prior art.

The present invention provides a base liquid for a MR fluid formulation having an appropriate viscosity, a depressed volatility, and a suitable pour point acceptable for use in MR devices. The base liquid also provides effective swell properties for elastomeric seals used in such MR devices. To that end, and in accordance with the present invention, the MR fluid formulation comprises magnetizable particles suspended in a base liquid or liquid vehicle of a mixture of a 1-dodecene polyalphaolefin (PAO) and an amount of a dibasic acid ester or diester sufficient to provide a swell of elastomeric seals wetted by the MR fluid effective to prevent or reduce the loss of base liquid about the seals.

The magnetorheological fluid formulations described herein are particularly useful for vibration damping in a number of MR devices for automotive applications, including brakes, pistons, clutches, mounts and dampers, which operate in the temperature range of about −40° C. to about 100° C. Certain MR devices utilized in automotive applications include one or more dynamic fluid seals that prevent the loss of MR fluid from the MR damper during operation. For example, MR dampers and MR mounts typically have a piston positioned for sliding movement in a tubular chamber, known as a damper body. The tubular body defines a reservoir filled with an MR fluid, which is partitioned into two compartments by the piston. The two sections are fluidly connected by a fluid passageway internal to the piston. In response to vibration, MR fluid is forced to pass through the fluid passageway to reflect the movement of the piston which changes the relative fluid volume of the two compartments. A magnetic field is applied in the vicinity of the fluid passageway, which alters the local viscosity of the flowing MR fluid and, thereby, modifies the damping response of the MR device to applied vibration. One end of a piston rod is attached to the piston and extends through an opening in the tubular chamber sealed by an elastomeric seal, typically formed of a polyurethane or a nitrile rubber. The opposite end of the piston rod is attached to an attachment point of the vehicle for which vibration is to be damped. The tubular chamber of such MR devices may also have an internal gas piston sealed by an elastomeric seal, typically formed of a polyurethane or a nitrile rubber, against the interior of the reservoir. The gas piston isolates a volume of gas that compresses and expands to accommodate changes in the volume of MR fluid displaced by the moving piston rod during operation of the device.

The present invention addresses the problem of the loss of MR fluid from an MR device, due to the emission of volatized base liquid at the upper end of the range of operating temperatures and due to the leakage of base liquid about elastomeric seals, by utilizing a base liquid containing a blended mixture of a dimer PAO produced from 1-dodecene, $H_2C{:}CH(CH_2)_9CH_3$, and a dibasic acid ester or diester, such as dioctyl sebacate. This base liquid mixture has an acceptable viscosity at continuous operating temperatures ranging between about −40° C. and about 100° C., a low volatility for continuous operating temperatures near the upper end of this range, and a pour point significantly less than −40° C. The base liquid also has the ability to swell the elastomeric seals of the MR device, which are wetted by the MR fluid, in an amount effective to significantly reduce the loss of base liquid about the seals. According to the present invention, the base liquid blended from 1-dodecene PAO and diester increases the operational or functional lifetime of the MR device by reducing the loss of MR fluid while retaining the ability to effectively lubricate the moving components of the MR device over the operating temperature range of about −40° C. to about 100° C. Specifically, the MR fluid formulations of the present invention include a base liquid prepared by blending the dimer 1-dodecene PAO and the diester to create a homogeneous mixture using conventional methods known to those of ordinary skill in the art.

The dimer 1-dodecene PAO and the diester are liquids at the operating temperatures of the intended MR device and have suitable viscosities when the MR device is unactivated to maintain a dispersion of magnetizable particles in a suspension. The monomer 1-dodecene PAO has a straight-chain carbon chain length of 12 carbon atoms. The dimer 1-dodecene PAO is made by an oligomerization reaction of $C_{12}$ monomer 1-dodecene PAO molecules to produce dimer 1-dodecene PAO molecules having a carbon chain length of 24 carbon atoms. Dimer 1-dodecene PAO exhibits a viscosity, a volatility and a lubricity suitable for use in a base liquid for an MR fluid formulation while retaining excellent low temperature flow, as manifested by its depressed pour point of about −52° C.

Dimer 1-dodecene PAO has a lower volatility, as described below, than either dimer 1-decene PAO or a 50:50 blend by volume of dimer 1-decene PAO with trimer 1-decene PAO. The dimer 1-dodecene PAO has a viscosity that is equally acceptable for use in MR devices operating at temperatures between about −40° C. and about 100° C. as a 50:50 blend by volume of dimer 1-decene PAO with trimer 1-decene PAO. Specifically, the dimer 1-dodecene PAO a viscosity at 20° C. of about 13.03 cp and a viscosity of about 95.6 cp at −20° C. A prior art base liquid for an MR fluid formulation containing a 50:50 mixture by volume of a dimer 1-decene PAO and a trimer 1-decene PAO has an effective viscosity of about 15.16 cp at 20° C. and an effective viscosity of about 107.3 cp at −20° C. It is apparent that the viscosities of the dimer 1-dodecene PAO are similar to the effective viscosities of the prior art 50:50 mixture of dimer and trimer 1-decene PAO. However, the dimer 1-dodecene PAO provides an acceptable viscosity over the range of continuous operating temperatures between about −40° C. and about 100° C. without the need to mix 1-decene PAO's.

Dimer 1-dodecene PAO has a significantly lower volatility than dimer 1-decene PAO at temperatures near 100° C. than, as will be described below. It follows that a base liquid for an MR fluid containing dimer 1-dodecene PAO will have a significantly lower volatility at temperatures near 100° C. than an MR fluid formulated with a base liquid containing dimer 1-decene PAO. Although trimer 1-decene PAO is added to the dimer 1-decene PAO to produce a base liquid with an acceptable effective viscosity, the volatility of the dimer 1-decene PAO is not significantly altered by the mixing process and the effective volatility of the mixture of dimer and trimer 1-dodecene PAO's remains significantly higher than the volatility of dimer 1-dodecene PAO for continuous operating temperatures near 100° C.

According to the present invention, formulating MR fluids with a base liquid containing dimer 1-dodecene PAO obviates the need to blend dimer 1-decene PAO and trimer 1-decene PAO to produce a base liquid having an acceptable viscosity over the continuous operating temperature range of about −40° C. to about 100° C. Furthermore, the 50:50 blend of dimer 1-decene PAO and trimer 1-decene PAO produces a base liquid which has a significant volatility at temperatures less than 100° C., which represents the upper operating temperature of MR devices used in certain automotive applications. Base liquids for MR fluids of the present invention containing dimer 1-dodecene PAO have a low volatility up to a significantly higher continuous operating temperature. As a result, the loss of base liquid for MR fluids of the present invention containing dimer 1-dodecene PAO will be less likely to occur, or will at least occur at a slower rate, than the loss of base liquid of either the prior art 50:50 blend of dimer 1-decene PAO and trimer 1-decene PAO or of a base liquid containing only dimer 1-decene PAO.

Diesters can be added to the dimer 1-dodecene PAO in an amount effective to produce the desired seal swell without significantly altering the effective viscosity of the base liquid to a value outside of the viscosity range acceptable for MR devices used in automotive applications over the temperature range of about −40° C. to about 100° C. In addition, diesters generally have a lower volatility than dimer 1-dodecene PAO over the range of continuous operating temperatures at which such MR devices operate. Thus, the addition of diester to dimer 1-dodecene PAO does not degrade the improvement in volatility of dimer 1-dodecene PAO over the prior art 50:50 blend of dimer 1-decene PAO and trimer 1-decene PAO or dimer 1-dodecene PAO. In most instances, the addition of diester to dimer 1-dodecene PAO improves the volatility.

Diesters are synthetic lubricant base liquids manufactured by reacting a monohydric alcohol with a dicarboxylic acid to create a linear, branched, or aromatic molecule having two ester groups. For example, dioctyl sebacate is a diester made by reacting a monohydric alcohol, such as n-octyl alcohol, isooctyl alcohol or 2-ethylhexyl alcohol, with sebacic acid. Linear diesters suitable for use in the present invention include, but are not limited to, dioctyl sebacate, dioleyl adipate, dioleyl sebacate, dioleyl maleate, dioleyl succinate, and dilinoleyl adipate. Unlike PAO's, the physical, chemical, and performance qualities of diesters can be varied substantially by altering the molecular structure, such as branching, aromaticity, alkyl chain length, and the number and position of the ester groups.

Diesters offer a wide range of properties suitable for use in the present invention, such as high temperature thermal and oxidative stability, low volatility, and low temperature fluidity, lubricity, and viscosity. Diesters particularly useful in the present invention have low acid numbers, typically less than about 0.1 mg KOH/g. The acid number is a measure of the amount of potassium hydroxide (KOH) needed to neutralize all or part of the acidity of a substance. Many elastomeric polymers, such as those, including polyurethane and nitrile rubber, commonly found in common MR devices in automotive applications, are swollen by diesters to an extent effective to reduce the loss of the base liquid of the MR fluid about the seals.

The seal swelling capability of the diester is desirable to balance the seal shrinkage or minimal seal swelling characteristics of the dimer 1-dodecene PAO. To that end and according to the present invention, diester is added to the dimer 1-dodecene PAO in an amount that is effective to produce a swell of elastomeric seals sufficient to accommodate the design goals of MR devices used in automotive applications. In particularly useful base liquids, diester is present in the base liquid of the fluid formulation in an amount between about 10% and about 45% by volume, relative to the total volume of the base liquid, and dimer 1-dodecene polyalphaolefin is present in an amount of about 55% to about 90% by volume of the total volume of the base liquid. In other particularly useful base liquids, diester is present in the base liquid of the fluid formulation in an amount between about 20% and about 40% by volume relative to the total volume of the base liquid, and the remainder of the mixture being dimer 1-dodecene PAO. It is apparent that the specific mixture ratio of dimer 1-dodecene PAO to diester will depend on the desired viscosity and volatility properties, as well as the specific type of elastomer used in the seals of the MR device and which are wetted by the base liquid.

The improved seal swell properties of the base liquids for the MR fluid formulations of the present invention can be illustrated by a comparison with a prior art base liquid. The seal swell properties or elastomeric compatibilities provided hereinafter are test data acquired by soaking various elastomeric seals of polyurethane and nitrile rubber, similar to those used in a typical MR device, in the base liquid for 70 hours at 100° C. A base liquid containing about 10% by volume of dioctyl sebacate, a representative diester, and about 90% by volume of dimer 1-dodecene PAO causes the elastomeric seals to swell by about 2 percent when wetted by the base liquid. A base liquid containing about 20% by volume of dioctyl sebacate and about 80% by volume of dimer 1-dodecene PAO causes the elastomeric seals to swell by about 3 percent when wetted by the base liquid. A base liquid containing about 40% by volume of dioctyl sebacate and about 60% by volume of dimer 1-dodecene PAO causes the elastomeric seals to swell by about 5 percent when wetted by the base liquid. In a prior art base liquid for an MR fluid formulation containing a 50:50 mixture by volume of dimer 1-decene PAO and trimer 1-decene PAO, the elastomeric seals of the MR device swell by less than 1 percent when wetted by the prior art base liquid. It is apparent that the prior art base liquid does not provide seal swell in the range of about 2% to about 6% as required for elastomeric compatibility with elastomeric seals for MR devices used in automotive applications. In contrast, it is equally apparent that the base liquids of the present invention have an elastomeric compatibility that provides a seal swell in the range of about 2% to about 6%, which is suitable for formulating MR fluids for use in automotive applications.

The suitability of the effective viscosity of the base liquids for the MR fluid formulations of the present invention for automotive applications can be illustrated by a comparison with a prior art base liquid. A base liquid containing about 10% by volume of dioctyl sebacate, a representative diester, and about 90% by volume of dimer 1-dodecene PAO has an effective viscosity of about 13.08 centipoise (cp) at 20° C. and an effective viscosity of about 96.9 cp at −20° C. A base liquid containing about 20% by volume of dioctyl sebacate and about 80% by volume of dimer 1-dodecene PAO has an effective viscosity of about 14.61 cp at 20° C. and an effective viscosity of about 102.0 cp at −20° C. A base liquid containing about 40% by volume of dioctyl sebacate and about 60% by volume of dimer 1-dodecene PAO has an effective viscosity at 20° C. of about 15.81 cp and an effective viscosity of about 112.9 cp at −20° C. A prior art base liquid for an MR fluid formulation containing a 50:50 mixture by volume of a dimer 1-decene PAO and a trimer 1-decene PAO has an effective viscosity of about 15.16 cp at 20° C. and an effective viscosity of about 107.3 cp at −20° C. Therefore, the base liquids of the present invention have viscosities that are similar to the viscosities of the prior art 50:50 mixture of dimer 1-decene PAO and trimer 1-decene PAO and that are also within the range of viscosities acceptable for use in MR devices operating in the temperature range of about −40° C. to about 100° C.

The addition of a diester also provides the additional benefit of improving the pour point of the dimer 1-dodecene PAO. For example, dioctyl sebacate, a representative diester, has a pour point of about −62° C. which is lower than the −52° C. pour point of dimer 1-dodecene PAO. As a result, a mixture of dioctyl sebacate and dimer 1-dodecene PAO will have a pour point less than dimer 1-dodecene PAO alone. Thus, the base liquid comprising a mixture of dimer 1-dodecene PAO and dioctyl sebacate will retain the ability to flow at an operating temperature of less than −52° C. Because the pour point is representative of the lower ambient temperature limit for the operation of an MR device utilizing an MR fluid based on this particular base liquid, the lower operating limit for the MR device is effectively lowered by the addition of the diester to the dimer 1-dodecene PAO. As a result, except for the most extreme operating environments, additives are not required to further depress the pour point of the base liquids of the present invention comprising a mixture of dimer 1-dodecene PAO and a diester, such as dioctyl sebacate.

A dimer 1-dodecene PAO having properties suitable for use in the present invention is commercially available under the trade name PAO 2.5 cSt from Chevron Corporation (San Francisco, Calif.). Lubricant grade diesters, such as adipates, sebacates, dodecanedioates, phthalates, and dimerates, are commercially available from Hatco Corporation (Fords, N.J.). Dioctyl sebacate is also commercially available from CasChem, Inc. (Bayonne, N.J.).

One aspect of the present invention can be demonstrated by a 24-hour evaporation loss measurement that compared a prior art base liquid consisting of a 50:50 mixture by volume of dimer 1-decene PAO and trimer 1-decene PAO with base liquids of the present invention containing dimer 1-dodecene PAO mixed with dioctyl sebacate, a representative diester. The prior art 50:50 base liquid was blended from a dimer 1-decene PAO and a trimer 1-decene PAO manufactured and sold by ExxonMobil Corporation (Irving, Tex.) under the tradenames SHF-21 and SHF-41, respectively. The base liquids of the present invention selected for the following demonstration were an 80:20 mixture of dimer 1-dodecene PAO and dioctyl sebacate and a 60:40 mixture of dimer 1-dodecene PAO and dioctyl sebacate. In the following demonstration, the base liquids are free from magnetizable particles and other additives.

The procedure utilized to perform the evaporation loss measurement was similar to the ASTM D972 procedure for determining evaporative weight loss of oil formulations. Specifically, a net weight of about 70 grams of each base liquid was poured into a respective 100 cc container. The containers were sealed and the initial gross weight of each container was measured using a precision balance having a resolution of about 0.1 milligram. The containers were unsealed and placed into an oven held at a constant temperature of 100° C.±1° C. The unsealed containers were maintained at the constant temperature for a test period of 24 hours. At the conclusion of the test period, the containers were removed from the oven, sealed, allowed to cool to ambient temperature, and weighed to provide a final gross weight. The evaporation loss of each base liquid over the test period was calculated from the change in gross weight as a percentage of the initial gross weight.

The weight loss of the 80:20 mixture of dimer 1-dodecene PAO and dioctyl sebacate was about 0.1817 percent and the weight loss of a 60:40 mixture of dimer 1-dodecene PAO and dioctyl sebacate was about 0.1757 percent. In contrast, the prior art 50:50 mixture of dimer 1-decene PAO and trimer 1-decene PAO exhibited a weight loss of about 0.3222 percent, which is 77 percent greater than the weight loss of the 80:20 mixture of dimer 1-dodecene PAO and dioctyl sebacate and 83 percent greater than the weight loss of the 60:40 mixture of dimer 1-dodecene PAO and dioctyl sebacate. From the results, it is apparent that the base liquids of the present invention experience significantly less evaporative loss at 100° C. than the prior art 50:50 mixture of dimer 1-decene PAO and trimer 1-decene PAO. The reduced volatility, as manifested by the reduction in the evaporative loss, is expected to be observed at other temperatures within the operating temperature range of −40° C. to about 100° C. It is appreciated from this demonstration that the base liquids of the present invention have a significantly lower volatility than the volatility of the prior art 50:50 mixture by volume of dimer 1-decene PAO and a trimer 1-decene PAO. The addition of dioctyl sebacate to dimer 1-dodecene PAO further reduces the volatility of dimer 1-dodecene PAO, which had an evaporative loss of about 0.2328 percent under substantially identical test conditions.

The test conditions of the present demonstration are representative of the volatilization that each base liquid would experience if deployed in an MR device operating at a continuous temperature near 100° C. The elastomeric seals that seal the MR fluid reservoirs of the MR devices are not designed nor intended to prevent vapor loss. Therefore, base liquid that is volatilized inside the reservoir of the MR device may escape about the elastomeric seals of the MR device and into the ambient environment. As a result, an MR device filled with an MR fluid formulation containing the base fluids of the present invention would experience a reduced fluid loss while operating at a temperature near 100° C. and exhibit a significantly longer service life than a comparable MR device filled with an MR fluid formulated from a base liquid of the prior art 50:50 mixture by volume of dimer 1-decene PAO and trimer 1-decene PAO and operating under identical or similar conditions.

Another aspect of the present invention can be demonstrated by thermal analysis that compares a base liquid for MR fluid formulations of the prior art using a 50:50 mixture by volume of a dimer 1-decene PAO and a 1-decene PAO with base liquids for MR fluid formulations of the present invention containing a mixture of dimer 1-dodecene PAO and dioctyl sebacate, a representative diester. In the following demonstration, the base liquids are free from magnetizable particles or other additives. The thermal analysis quantifies the thermal stability of each base liquid with thermogravimetric analysis (TGA), which may be performed using a commercial instrument such as a Q-50 TGA instrument manufactured by TA Instruments (New Castle, Del.). In general, TGA monitors the weight loss of a sample of a condensed phase, due to gas release or volatilization, as the temperature of the sample is ramped over a given temperature range to produce a weight loss curve. A differential weight loss curve as a function of temperature is derived by taking the first derivative of the weight loss curve. TGA provides a method of comparing the relative volatility of liquids and analyzing the relative volatility of mixtures of liquids.

FIG. 1 depicts the derivative weight loss as a function of temperature measured by TGA for a prior art base liquid consisting of a 50:50 mixture by volume of dimer 1-decene PAO and trimer 1-decene PAO. The derivative weight loss was calculated from the weight loss of a sample of the 50:50 mixture by volume of dimer 1-decene PAO and trimer 1-decene PAO, as measured by TGA, over a temperature range from about 80° C. to about 250° C. With reference to FIG. 1, perceptible weight loss onsets at a threshold temperature of about 100° C. and observable weight loss continues to a maximum temperature of about 235° C. It can be observed that the derivative weight loss curve exhibits a bimodal distribution. The curve of FIG. 1 exhibits two approximately equal-height Gaussian-like peaks of a given peak width separated by a temperature difference of about 60° C. Each peak represents the temperatures at which the rate of weight loss is maximized for a particular component in the mixture. The first peak, centered about a mode of about 130° C., is characteristic of the volatilization of the dimer 1-decene PAO. The second peak, centered about a mode of about 192° C., is characteristic of the volatilization of the trimer 1-decene PAO. Thus, it is apparent that dimer 1-decene PAO has a higher volatility than trimer 1-decene PAO.

Figure 2:
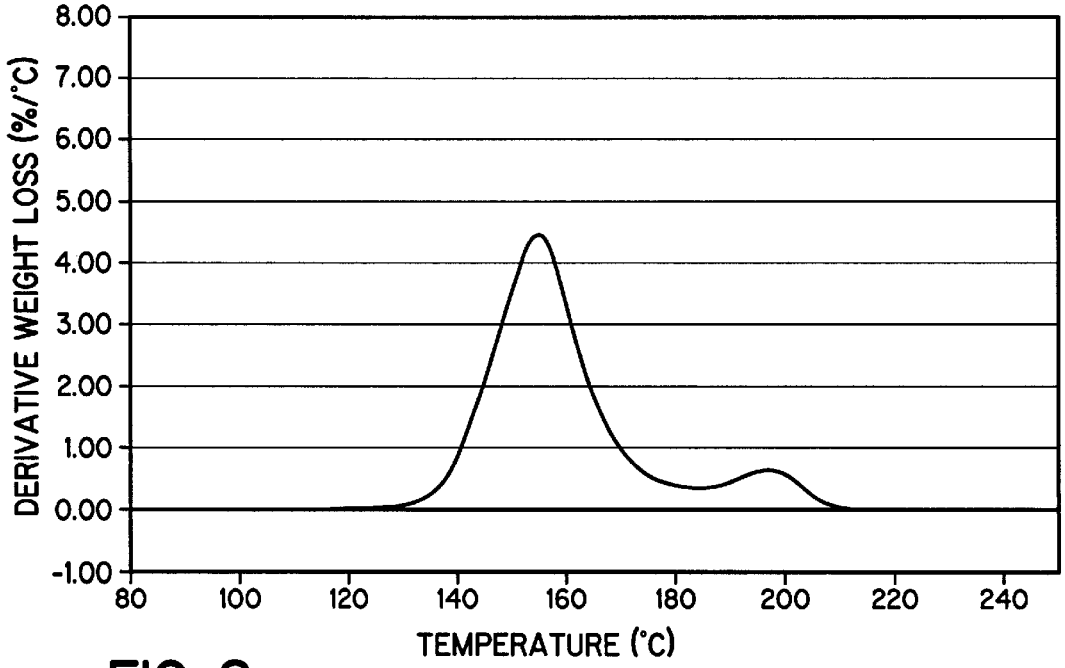
FIG. 2 is a graphical representation of a thermogravimetric analysis of a base liquid for an MR fluid formulation of a 80:20 mixture by volume of a dimer 1-dodecene polyalphaolefin and a dioctyl sebacate in accordance with an embodiment of the present invention.

FIG. 2 depicts the derivative weight loss as a function of temperature for a base liquid of the present invention comprising a 80:20 mixture by volume of dimer 1-dodecene PAO and dioctyl sebacate. The derivative weight loss was calculated from the weight loss of a sample of the 80:20 mixture by volume of dimer 1-dodecene PAO and dioctyl sebacate as measured by TGA over a temperature range from about 80° C. to about 250° C. Compared with FIG. 1, however, the onset of perceptible weight loss now occurs at a threshold temperature of about 130° C. and continues to a maximum temperature of about 210° C. It can be observed that, similar to FIG. 1, the derivative weight loss curve exhibits a bimodal distribution of weight loss. The curve exhibits two Gaussian-like peaks of a given peak width separated by about 40° C., wherein the first peak, centered about a mode of about 155° C., is characteristic of the volatilization of the dimer 1-dodecene PAO and the second peak, centered about a mode of about 195° C., is characteristic of the volatilization of the dioctyl sebacate.

From a comparison of the TGA curve of FIG. 2 with the TGA curve of FIG. 1, it is apparent that this particular base liquid of the present invention resists the onset of significant volatility until a higher temperature than the base liquid of the prior art 50:50 mixture by volume of dimer 1-decene PAO and trimer 1-decene PAO. It is known that the loss of MR fluid from the MR device due to the escape of volatilized base liquid about the elastomeric seals gradually degrades the vibration damping performance of the MR device and may result in premature failure of the MR device. It follows that an MR device using an MR fluid formulated from the 80:20 mixture by volume of dimer 1-dodecene PAO and dioctyl sebacate can operate, without either premature failure due to fluid loss or loss of vibration damping performance due to fluid loss, at a higher continuous operating temperature than an MR device utilizing an MR fluid formulated from the base liquid of the prior art 50:50 mixture by volume of dimer 1-decene PAO and trimer 1-decene PAO. The information contained in the TGA curves of FIGS. 1 and 2 complements the 24-hour evaporation loss measurements described above, which are more representative of the volatility that can be expected of the base liquids of the present invention when held at a continuous elevated operating temperature.

Figure 3:
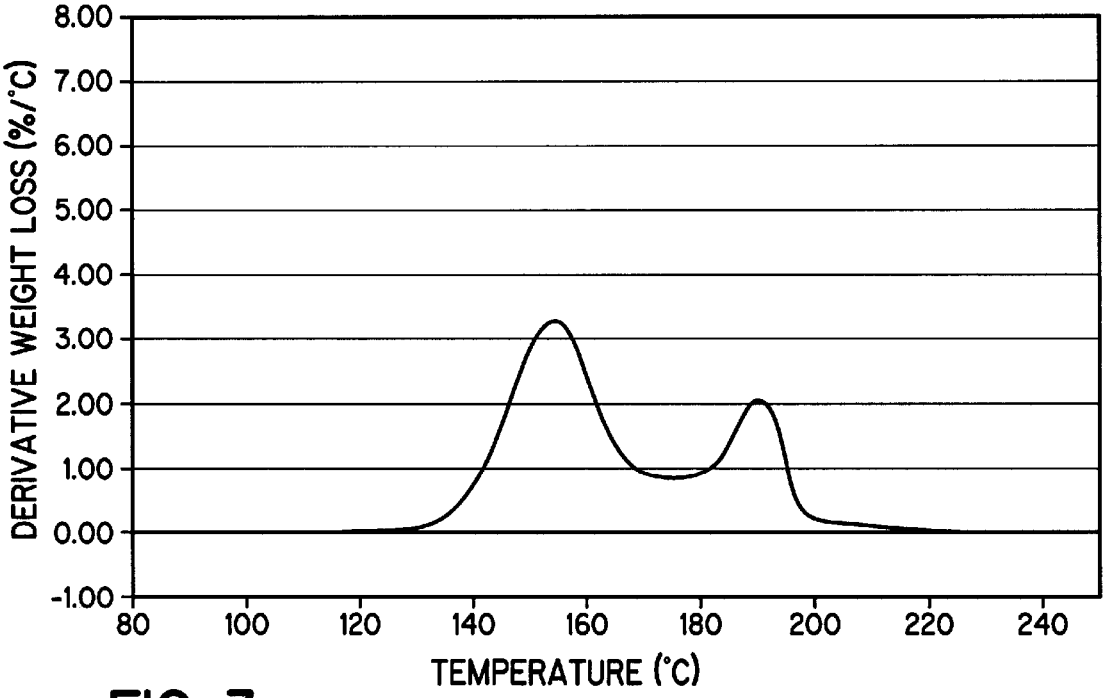
FIG. 3 is a graphical representation of a thermogravimetric analysis of a base liquid for an MR fluid formulation of a 60:40 mixture by volume of a dimer 1-dodecene polyalphaolefin and a dioctyl sebacate in accordance with an embodiment of the present invention.

FIG. 3 depicts the derivative weight loss as a function of temperature for a base liquid of the present invention comprising a 60:40 mixture by volume of a dimer 1-dodecene PAO and a dioctyl sebacate as measured by TGA over a temperature range from about 80° C. to about 250° C. It can be observed that, similar to FIG. 2, the derivative weight loss curve exhibits a bimodal distribution of weight loss with the first Gaussian-like peak centered about a mode of about 155° C. being characteristic of the volatilization of the dimer 1-dodecene PAO and the second Gaussian-like peak centered about a mode of about 190° C. being characteristic of the volatilization of the dioctyl sebacate. Because the base liquid having the 60:40 mixture contains less dimer 1-dodecene PAO than the base liquid having the 80:20 mixture, the peak in FIG. 3 near 155° C. characteristic of the volatilization of dimer 1-dodecene PAO has a lesser magnitude than the corresponding peak in FIG. 2.

If the TGA curve of FIG. 3 is compared with the TGA curve of FIG. 1, it is apparent that this particular base liquid of the present invention also does not exhibit significant volatility until a higher temperature than the base liquid of the prior art 50:50 mixture by volume of dimer 1-decene PAO and trimer 1-decene PAO. It follows that an MR device using an MR fluid formulated from the 60:40 mixture by volume of dimer 1-dodecene PAO and dioctyl sebacate can operate, without either premature failure due to fluid loss or loss of vibration damping performance due to fluid loss, at a higher continuous operating temperature than an MR device containing an MR fluid formulated from the base liquid of the prior art 50:50 mixture by volume of dimer 1-decene PAO and trimer 1-decene PAO.

The magnetizable particles added to the base liquid to form the MR fluid formulation can be any solid that is known to exhibit magnetorheological activity. By way of example, the magnetizable particles suitable for use in the fluids are magnetizable ferromagnetic, low coercivity, finely divided particles of iron, nickel, cobalt, iron-nickel alloys, iron-cobalt alloys, iron-silicon alloys and the like which are spherical or nearly spherical in shape and have a diameter in the range of about 1 micron to about 100 microns. Because the particles are employed in noncolloidal suspensions, it is preferred, but not limiting, that the particles be at the small diameter regime of the suitable range, preferably in the range of about 1 micron to about 10 microns in nominal diameter or particle size. The magnetizable particles may also have a bimodal size distribution, such as that described in U.S. Pat. No. 5,657,715, issued Sep. 16, 1997, entitled "Magnetorheological Fluids" incorporated by reference herein in its entirety. For example, the magnetizable particles may be a mixture of spherical particles in the range of about 1 micron to about 100 microns in diameter with two distinct particle size members present, one a relatively large particle size that is about 5 to 10 times the mean diameter of the relatively small particle size component.

The MR fluid formulation of the present invention may optionally include one or more types of additives normally used for lubricant oils such as surfactants and dispersing agents, thixotropic agents, carboxylate soaps, corrosion inhibitors, friction reducing agents, anti-wear agents, oxidation inhibitors, rust inhibitors, anti-settling agents, antifoamants, and rheology modifiers. Surfactants, for example, are known to reduce the tendency for coagulation of the magnetizable particles during utilization of MR fluids. Such surfactants include known surfactants or dispersing agents such as ferrous oleate and naphthenate, metallic soaps (e.g., aluminum tristearate and distearate), alkaline soaps (e.g., lithium and sodium stearate), sulfonate, phosphate esters, stearic acid, glycerol monooleate, sorbitan sesquioleate, stearates, laurates, fatty acids, fatty alcohols, and other surface active agents. In addition, the surfactant may be comprised of stearic stabilizing molecules, including fluoro-aliphatic polymeric esters and titanate, aluminate or zirconate coupling agents. Also by way of example, the surfactant may be ethoxylated tallow alkyl amine, ethoxylated coco alkyl amine, ethoxylated oleyl amine, ethoxylated soya alkyl amine, ethoxylated octadecyl amine or an ethoxylated diamine such as ethoxylated N-tallow-1,3-diamino propane. The magnetizable particles may be coated with the surfactant by methods know to those of ordinary skill in the art. As another example, thixotropic agents thicken the MR fluid when static so that the magnetizable particles in the base liquid will remain dispersed in suspension. Known thixotropic agents include materials such as hydrophobic organoclays and fumed metal oxides, such as a fumed silicon oxide.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A magnetorheological fluid formulation for a magnetorheological device comprising a plurality of magnetizable particles and a base liquid for dispersing the plurality of magnetizable particles, the base liquid including a dimer 1-dodecene polyalphaolefin and a diester.

2. The formulation of claim 1, wherein the magnetizable particles are selected from the group consisting of iron, nickel, cobalt and magnetic alloys thereof.

3. The formulation of claim 1, wherein the diester is selected from the group consisting of dioctyl sebacate, dioleyl adipate, dioleyl sebacate, dioleyl maleate, dioleyl succinate, and dilinoleyl adipate.

4. The formulation of claim 1, wherein the diester is dioctyl sebacate.

5. The formulation of claim 1, wherein the diester has an acid number less than about 0.1 mg KOH/g.

6. The formulation of claim 1, wherein the diester is present in the fluid formulation in an amount between about 10% and about 45% by volume relative to the total volume of the base liquid.

7. The formulation of claim 6, wherein the diester is present in the fluid formulation in an amount between about 20% and about 40% by volume relative to the total volume of the base liquid.

8. The formulation of claim 1, wherein the diester is present in the fluid formulation in an amount effective to swell an elastomeric seal of the magnetorheological device by between about 2 percent and about 6 percent when wetted by the base liquid.

9. The formulation of claim 1, wherein the diester is present in the fluid formulation in an amount effective to lower the pour point of the formulation to less than about −52° C.

10. The formulation of claim 1, wherein the diester is present in the fluid formulation in an amount effective to provide resistance to significant volatization at temperatures up to about 100° C.

11. A magnetorheological fluid formulation for a magnetorheological device comprising a plurality of magnetizable particles and a base liquid for dispersing the plurality of magnetizable particles, the base liquid including a dimer 1-dodecene polyalphaolefin present in an amount of about 55% to about 90% by volume of the total volume of the base liquid and a diester present in an amount of about 10% to about 45% by volume of the total volume of the base liquid.

12. The formulation of claim 11, wherein the magnetizable particles are selected from the group consisting of iron, nickel, cobalt and magnetic alloys thereof.

13. The formulation of claim 11, wherein the diester is selected from the group consisting of dioctyl sebacate, dioleyl adipate, dioleyl sebacate, dioleyl maleate, dioleyl succinate, and dilinoleyl adipate.

14. The formulation of claim 11, wherein the diester is dioctyl sebacate.

15. The formulation of claim 11, wherein the diester has an acid number less than about 0.1 mg KOH/g.

16. The formulation of claim 11, wherein the diester is present in the fluid formulation in an amount between about 20% and about 40% by volume relative to the total volume of the base liquid.

17. A magnetorheological fluid formulation for a magnetorheological device comprising a plurality of magnetizable particles and a base liquid for dispersing the plurality of magnetizable particles, the base liquid including a dimer 1-dodecene polyalphaolefin present in an amount of about 55 percent to about 90 percent by volume of the total volume of the base liquid and dioctyl sebacate present in an amount of about 10 percent to about 45 percent by volume of the total volume of the base liquid, wherein the formulation has a pour point less than about −52° C. and wherein the formulation is capable of swelling an elastomeric seal in the magnetorheological device by between about 2 percent and about 6 percent when wetted by the magnetorheological fluid.

18. A method of formulating a magnetorheological base liquid for a magnetorheological device having an elastomeric seal, comprising:

selecting dimer 1-dodecene polyalphaolefin as a first liquid;

selecting a second liquid have a lower volatility than dimer 1-decene polyalphaolefin at a temperature near 100° C. and capable of swelling an elastomeric seal by between about 2 percent and about 6 percent when the elastomeric seal is wetted by the second liquid; and blending with the first liquid with the second liquid to formulate a magnetorheological base liquid.

19. The method of claim 18 wherein the first liquid is free of 1-decene polyalphaolefin molecules.

20. The method of claim 18 wherein selecting the second liquid further comprises:

providing the second liquid in an amount of about 10% to about 45% by volume of the total volume of the magnetorheological base liquid.

* * * * *